United States Patent [19]

Clancy

[11] Patent Number: 4,876,415

[45] Date of Patent: Oct. 24, 1989

[54] LOW COST KEYBOARD WITH KEY TOPS DEFINING SURFACE OF CURVED PROFILE

[75] Inventor: Kevin F. Clancy, El Paso, Tex.

[73] Assignee: Honeywell, Inc., Minneapolis, Minn.

[21] Appl. No.: 175,556

[22] Filed: Mar. 31, 1988

[51] Int. Cl.[4] ..... H01H 9/00; H01H 13/70

[52] U.S. Cl. ..... 200/5 A; 200/517; 200/600; 400/479.1; 400/488

[58] Field of Search ..... 200/5 R, 5 A, 159 B, 200/292, 293, DIG. 001, 517, 600; 340/365 C; 235/145 R; 361/398; 400/479–479.2, 488; 341/22, 26, 33

[56] References Cited

U.S. PATENT DOCUMENTS

| | | | |
|---|---|---|---|
| 4,359,720 | 11/1982 | Chai et al. | 340/365 C |
| 4,363,942 | 12/1982 | Deeg et al. | 200/5 A X |
| 4,467,150 | 8/1984 | Leitermann et al. | 200/292 X |
| 4,528,428 | 7/1985 | Gotoh et al. | 361/398 X |
| 4,560,844 | 12/1985 | Takamura et al. | 200/293 X |
| 4,560,845 | 12/1985 | Takamura et al. | 235/145 R X |
| 4,605,828 | 8/1986 | Gostomski, Jr. et al. | 200/5 A |
| 4,659,879 | 4/1987 | Hasegawa | 340/365 C X |
| 4,735,520 | 4/1988 | Suzuki et al. | 400/488 |
| 4,736,076 | 4/1988 | Mochizuki et al. | 200/159 B X |
| 4,760,217 | 7/1988 | Suzuki et al. | 200/5 A |

*Primary Examiner*—J. R. Scott

*Attorney, Agent, or Firm*—Charles L. Rubow

[57] ABSTRACT

A keyboard having a plurality of rows of depressable keys whose key tops define a surface of concave profile curved about an axis. The concave profile is achieved with key tops and key stems of identical configuration by maintaining a key holder plate which carries the key stems in a concave profile. The concave profile of the key holder plate is produced by forming the plate with graduated flexibility across its width and mounting it on a substantially rigid base so that a region of the plate located midway between its edges is drawn to a position outside the plane containing the edges of the plate by means of a plurality of fasteners between the base and a plate located along its length.

12 Claims, 3 Drawing Sheets

LOW COST KEYBOARD WITH KEY TOPS DEFINING SURFACE OF CURVED PROFILE

BACKGROUND OF THE INVENTION

The invention disclosed herein relates generally to keyboard apparatus, and more particularly to simplified construction of a keyboard in which the key tops define a surface of concave profile.

It is known that arranging the keys on a keyboard so that the key tops define a surface of concave profile provides ergonometric advantages. Specifically, arranging rows of key tops in a concave surface of proper radius about an axis decreases operator fatigue and aids in increasing operator speed and length of time of effective performance.

Various keyboard designs are known which provide the desired key top arrangement profile. In one such design, the structure in which the keys are carried is basically planar. The stem length and cap configuration for each key are selected as a function of the location of the key on the keyboard. This design has the disadvantage that keys having a variety of different stem lengths and cap configurations must be produced, and care must be used in assembly to insure that the proper key parts are used at each location.

The foregoing disadvantage is avoided in another design in which a rigid key mounting structure is preformed with the proper curvature. In such a design, keys of identical configuration can be used at all locations. However, such a design essentially requires that a key mounting structure be formed by a process and of materials other than molded plastic. Molding of a unitary rigid curved key holder plate is not feasible since a curved configuration and radially aligned key guide apertures preclude formation by a simple conventional mold.

A rigid curved mounting plate may be formed of sheet metal. However, with such construction, the mounting plate must generally be fitted with key guides, which is disadvantageous since extra parts and assembly steps are required. In addition, metal construction weighs more and is more expensive than construction of plastic materials.

U.S. Pat. No. 4,528,428 issued to H. Gotoh et al. on July 9, 1985 and 4,560,844 and 4,560,845 issued to T. Takamura et al on Dec. 24, 1985 disclose yet another curved keyboard design in which a flexible key holding structure is molded in planar form with integral key guide apertures. The key holding structure is then clamped to a first housing portion in a desired curved configuration by a rigid retainer plate. A mating housing portion is configured to provide additional support in maintaining the key holding structure in the desired configuration.

The key holding structure may be provided with longitudinal grooves or series of aligned slots between rows of keys for increasing flexibility of the structure transverse to the rows. It is also disclosed that the grooves may be formed of greater depth toward the outer edges of the structure to obtain desired deformation of the structure.

Although this arrangement is relatively simple and inexpensive, it requires a rigid curved retainer plate and individual fastening of the circuit board and the retainer plate to the first housing portion, and then assembly with a second housing portion to provide added support for maintaining the desired curvature.

Competitive pressures in the market place continue to dictate keyboard cost reductions. This necessitates fewer and more easily assembled parts. The applicant has devised a unique design fabricated entirely of inexpensive lightweight plastic parts in which the parts count is minimized and assembly is easily accomplished by snapping the parts together without any requirement for separate fasteners or fastening procedures.

SUMMARY OF THE INVENTION

The present invention is a low cost, light weight keyboard with key tops defining a surface of curved profile and a method of manufacturing such a keyboard. The keyboard basically comprises a key holder plate having a plurality of rows of key guide apertures therethrough and having graduated flexibility transverse to the rows of apertures. A substantially rigid base underlies the key holder plate. Retaining means between the base and the key holder plate restrains the key holder plate in a position in which the edges of the key holder plate proximate the outer rows of key guides lie in a plane and an area of the key holder plate along a line intermediate the edges thereof is maintained outside the plane to restrain the key holder plate in a curved profile.

Graduated flexibility of the key holder plate may be achieved by rows of aligned slots between the rows of key guides, the lengths of the slots increasing with distance from the center line of the key holder plate. The restraining means may comprise a pair of ribs along opposite edges of the key holder plate between the key holder plate and the base to elevate the edges of the key holder plate and a plurality of fasteners along the area intermediate the edges of the key holder plate to hold that area of the key holder plate toward the base.

The method of producing a keyboard of curved profile comprises providing an actuator assembly including a plurality of rows of keys mounted in a key holder plate having graduated flexibility transverse to the rows of keys, and providing a switch assembly including a substantially rigid base having a concave upper surface thereon. The switch assembly includes a membrane assembly and an array of key return elements overlaying the concave surface on the base. The method comprises the further step of attaching the actuator assembly to the concave surface on the base in a manner that the edges of the key holder plate are elevated from the concave surface and the area of maximum stiffness of the key holder plate midway between the outer rows of keys is drawn toward the concave surface by means of a plurality of fasteners along the length of the area of maximum stiffness.

DESCRIPTION OF THE PREFERRED EMBODIMENT

Figure 1:
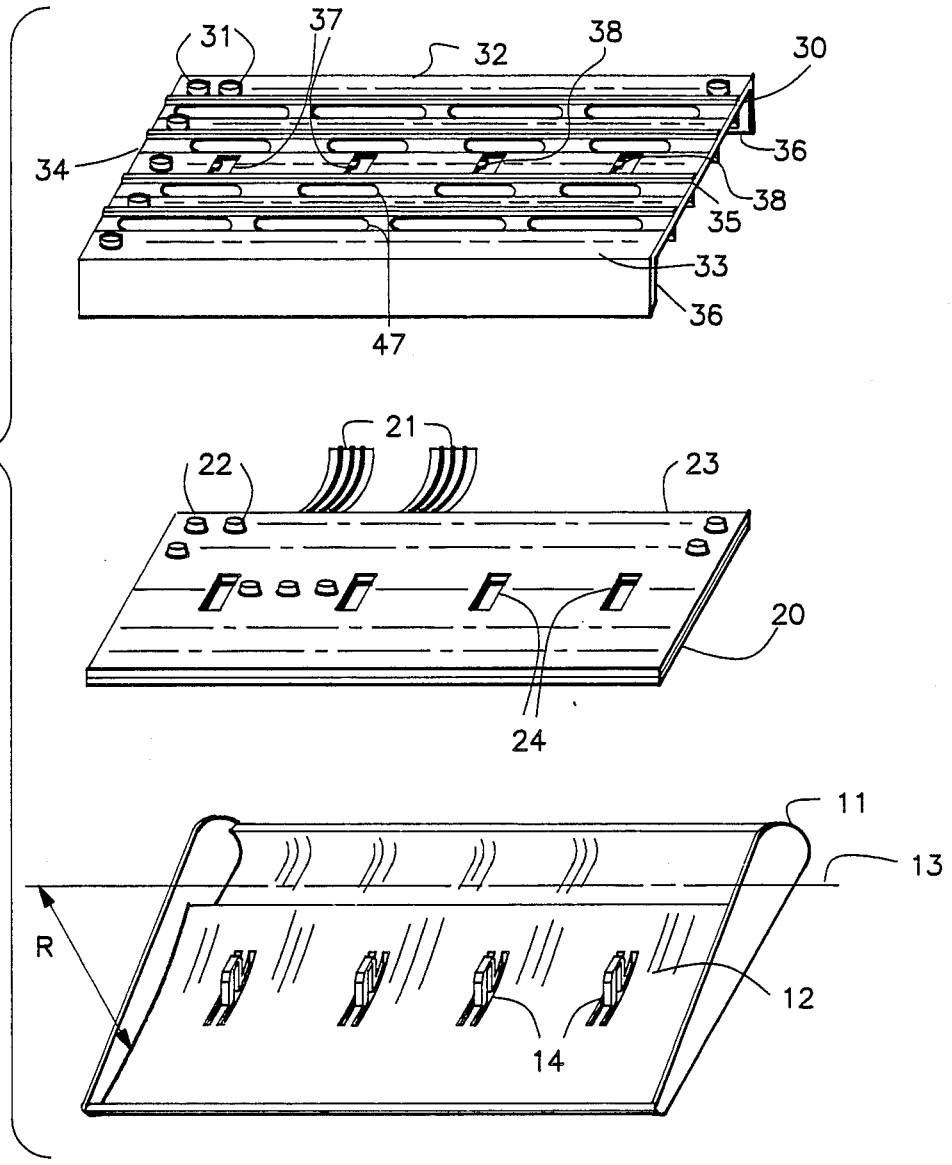
FIG. 1 is an exploded perspective view of a keyboard (cover missing) in accordance with the applicant's invention.

In the exploded view of the applicant's keyboard shown in FIG. 1, reference numeral 11 identifies a substantially rigid base, which may be of molded plastic, having a concave upper surface 12 thereon. Surface 12 is curved about an axis 13, and is shown as lying at a radius R from the axis. Shown lying along a line parallel with axis 13 and lying midway between the edges of surface 12 is a plurality of resilient snap fasteners 14 which will be described in more detail hereinafter.

Overlaying surface 12 is a membrane capacitive switch assembly 20 partially shown in FIGS. 5 and 6 and described in greater detail hereinafter. Reference number 21 identifies tails extending from layers of membrane switch assembly 20 carrying connecting conductors to external circuitry.

Overlaying switch assembly 20 is an array of resilient switch actuator/key return elements or boots 22 shown molded of a rubber like material in a unitary sheet 23. A portion of sheet 23 including single boot 22 is shown in enlarged cross section in FIG. 6. Boots 22 are also described in greater detail hereinafter. Switch assembly 20 and sheet 23 are shown with apertures 24 therethrough for accommodating resilient clips or bails formed as integral parts of base 11.

Overlaying sheet 23 is a key holder plate 30 shown having a plurality of rows of key guide apertures 31 therethrough parallel with axis 13. Key holder plate 30 has mutually orthogonal width, length and thickness. Key guide apertures 31 extend through the thickness thereof. The width of plate 30 extends between lines coinciding with edges 32 and 33 and the length extends between ends 34 and 35. As a result of features described hereinafter, plate 30 is relatively rigid along its length, and has graduated flexibility across its width.

Projecting downwardly from edges 32 and 33 are ribs 36 which, when the keyboard is assembled, rest on surface 12 of base 11. Key holder plate 30 is also formed with a plurality of apertures 37 along an area midway between edges 32 and 33. A laterally extending projection 38 is formed on plate 30 at each aperture 37, and is adapted to cooperate with a bail 14 on base 11 for retaining plate 30 and switch assembly 20 and sheet 23 in place. For convenience, a bail 14 and its associated projection 38 together are referred to as a snap fastener or retaining means.

Figure 2:
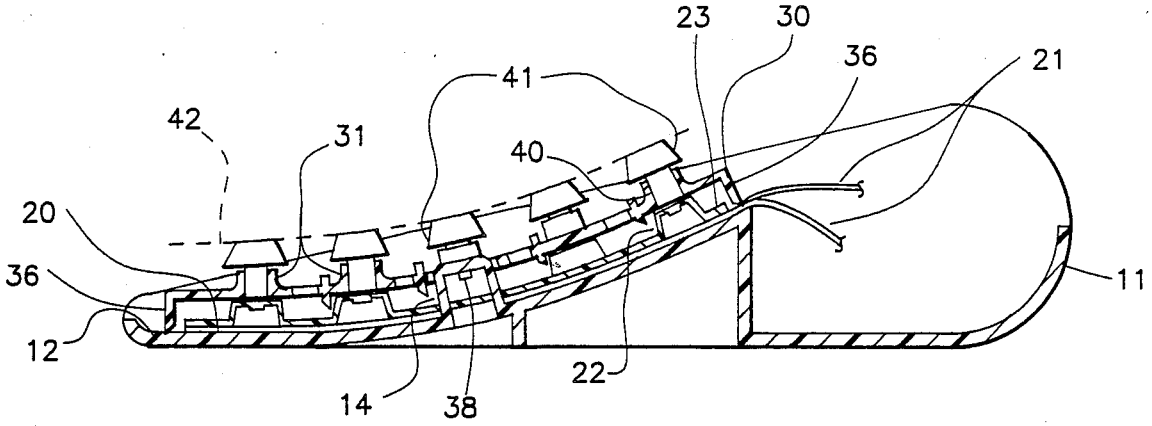
FIG. 2 is an elevation view in cross section of the keyboard of FIG. 1.

As shown in FIG. 2, key holder plate 30 is restrained in a concave profile approximately the same as that of surface 12 on base 11 by means of downwardly projecting ribs 36 on the key holder plate and fasteners 14. Key guide apertures 31 carry key stems 40 of which the lower ends abut the exterior surfaces of the the tops of boots 22. Key caps 41 are mounted on the upper ends of key stems 40. The curved configuration of key holder plate 30, when mounted on surface 12 on base 11, permits key stems and key caps of identical configuration to be used in key guides apertures 31 at all locations. The top surfaces of key caps 41 define a concave operating surface 42 whose curvature is chosen to maximize operator efficiency.

In order to achieve the desired curvature with a three point constraint across the profile of key holder plate 30, it is necessary that flexibility across the plate be graduated to account for the different moment arm lengths across the plate. The means for achieving this characteristic as well as relative rigidity along the length of the plate 30 is shown in FIGS. 3 and 4, which also show various other details associated with the plate.

Rigidity along the length of key holder plate 30 is achieved by longitudinal ribs 44 formed on the lower surface and longitudinal ribs 45 formed on the upper surface of plate 30. Flexibility transverse to ribs 44 and 45 is enhanced by shallow grooves 46 in the upper surface of plate 30 adjacent ribs 45. Flexibility is further enhanced by forming slots 47 through plate 30 in grooves 46. Flexibility is graduated by forming the slots of different lengths based on distance across the width of the plate from the central region thereof. More specifically, the lengths of the slots increase with distance from the central region as shown in FIGS. 1 and 3 to produce a concave profile of uniform curvature.

Figure 3:
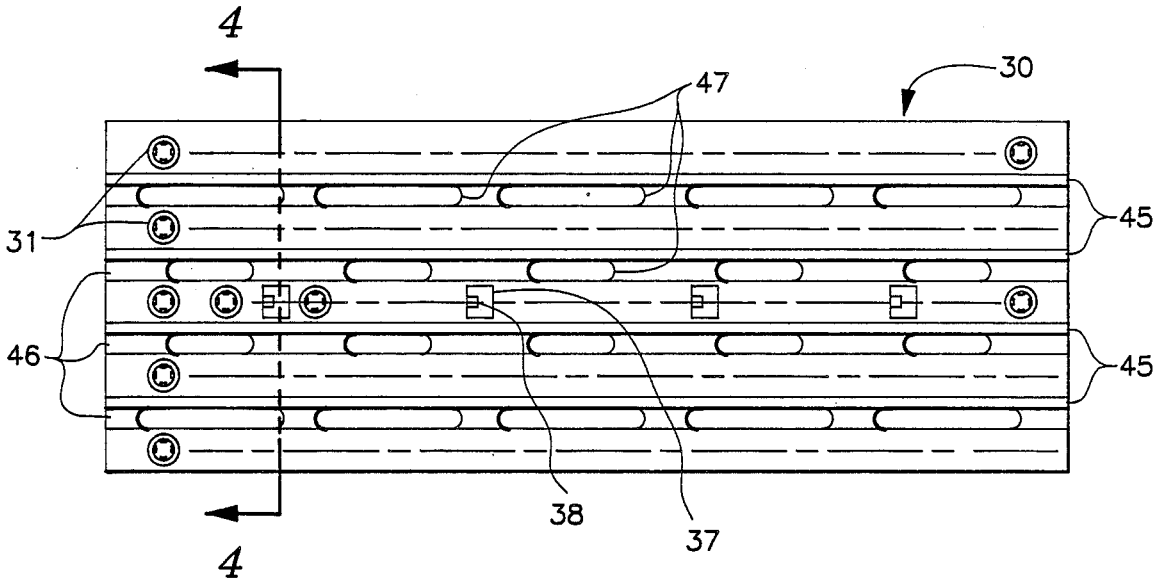
FIG. 3 is a plan view of a key holder plate used in the keyboard of FIG. 1.
Figure 4:
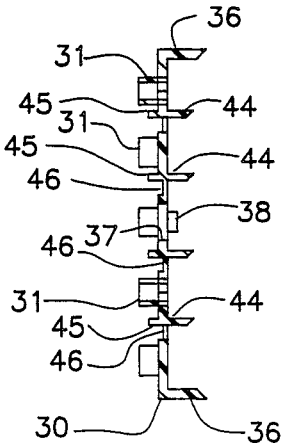
FIG. 4 is a cross sectional view of the key holder plate shown in FIG. 3 taken along lines 4—4.

Also shown in FIG. 3 are internal details of key guide apertures 31. The key guide apertures contain inwardly directed projections which mate with grooves in key stems 40 to prevent rotation of the key stems and associated key tops.

Figure 7:
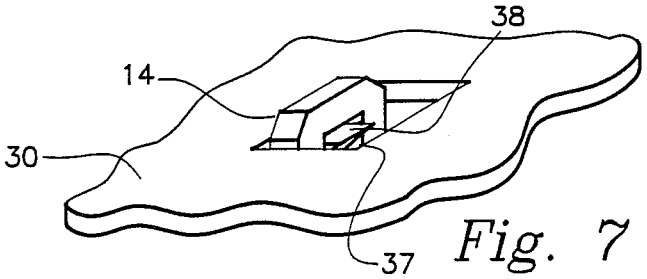
FIG. 7 is an enlarged perspective view of a portion of the keyboard of FIGS. 1 and 2, showing details of integral snap fasteners for securing the keyboard base, membrane switch assembly and key holder plate together.

Each lateral projection 38 associated with an aperture 37 is formed with a beveled lower surface thereon which deflects the associated bail 14 on base 11 to the side as key holder plate 30 is pressed into place. The manner in which bail 14 and projection 38 cooperate to form a snap fastener can best be seen in FIG. 7. When plate 30 is pressed into place in the proper position, bails 14 snap back over the tops of projections 38 to hold the plate in place. Thus, the entire keyboard assembly, including base 11, return element sheet 23 and plate 30 are assembled and held in place without the use of tools or separate fasteners. In addition, no separate retainer plate is required to maintain proper curvature of key holder plate 30 or for any other reason. Such construction minimizes parts count and contributes to simplicity and ease of assembly, thus minimizing cost and weight of the keyboard.

Figure 5:
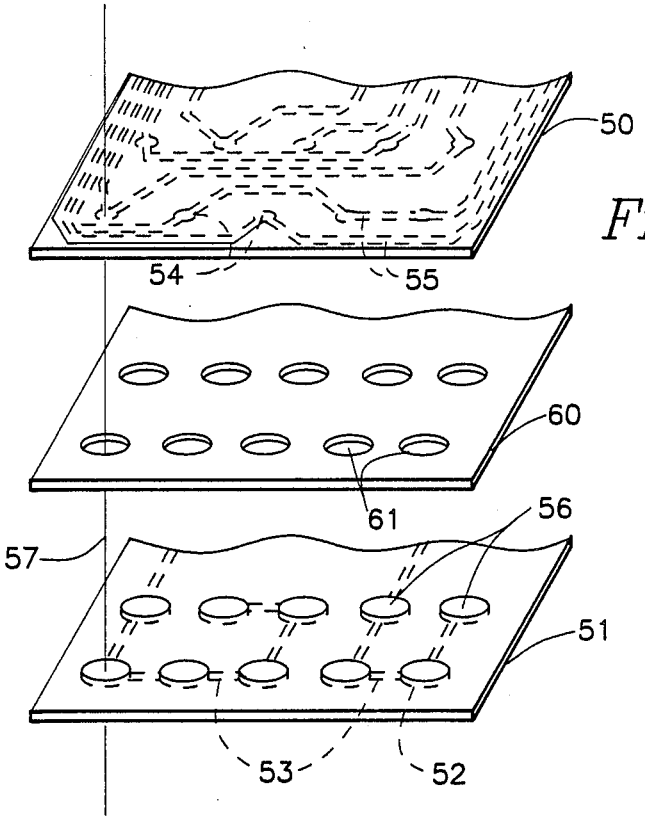
FIG. 5 is a partial exploded view of a capacitive membrane switch assembly used in the keyboard of FIGS. 1 and 2.
Figure 6:
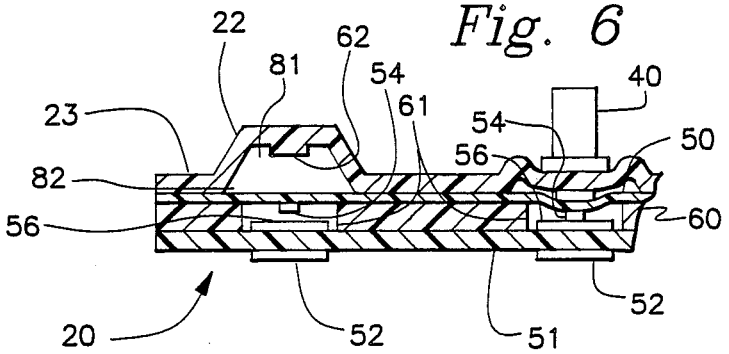
FIG. 6 is an enlarged partial cross sectional view of the assembled capacitive membrane switch assembly of FIG. 5 with an associated switch actuator and key return element.

FIGS. 5 and 6 show the various components of a capacitive membrane switch assembly which may be used in the keyboard of FIGS. 1 and 2. Reference numerals 50 and 51 identify flexible substrates which carry electrically conductive patterns forming various capacitor and electrical conductor elements. The substrate may be made of Mylar (a trademark of the E. I. DuPont DeNemours Corporation). A first pattern of conductive material is formed on the lower surface of substrate 51. This conductive pattern includes an array of areas 52 which comprise fixed plates of an array of capacitors. Fixed plates 52 are connected in groups by conductors 53 which also connect the groups of plates to conductors on one of tails 21 shown in FIG. 1.

A second pattern of conductive material is located on the lower surface of substrate 50. This conductive pattern includes an array of variable capacitor plates 54 and a second plurality of conductors 55 which connect groups of the variable capacitor plates to conductors on the other of tails 21 shown FIG. 1. Capacitor plates 52 and 54 are arranged in substantially identical patterns with substantially identical spacing.

A third pattern of conductive material is located on the upper surface of substrate 51. This pattern of conductive material forms an array of capacitor plates 56 aligned with capacitor plates 52 and 54 in a direction perpendicular to the surfaces of substrates 50 and 51 as shown by axis 57. Capacitor plates 56 are electrically isolated from one another and are not normally connected to any electronic circuitry.

A spacer sheet 60 is interposed between the lower surface of substrate 50 and the upper surface of substrate 51. Spacer sheet 60 has apertures 61 therethrough at the locations of the capacitors so as to normally maintain a predetermined spacing between capacitor plates 54 and capacitor plates 56. However, apertures 61 and the flexibility of substrate 50 permit the spacing between individual capacitor plates 54 and 56 to be varied to the extent that capacitor plates 54 come into electrical contact with capacitor plates 56 upon the application of force to the upper surface of substrate 50 at the locations of the capacitor plates.

Actuation force is selectively applied to the upper surface of substrate 50 by means of resilient boots 22 formed on a sheet 23. As shown in FIGS. 1 and 6, each boot is of a hollow frustoconical form having a small closed end 81 at its top and a larger open end 82 at its bottom. The internal surface of the top of each boot 22 is formed with a button 62 thereon adapted to contact and depress a predetermined area of substrate 50 when the top is depressed by the bottom of a key stem 40. Switch actuator/key return element 22 also serves to bias its associated key stem and key top to its upper or undepressed position when the key is not being depressed by an operator.

For a more complete description of the structure and operation of a membrane capacitive key switch assembly suitable for use in the keyboard disclosed herein, reference may be made to U.S. Pat. No. 4,359,720 issued Nov. 16, 1982 to T. Chai, et al. and assigned to the same assignee as the present application.

In accordance with the foregoing description, the applicant has provided a keyboard with an ergonometrically efficient operating surface using only a minimum number of simple easily assembled parts whose assembly does not require special tools or separate fasteners. Although a specific embodiment has been shown and described for illustrative purposes, a number of variations and modifications will be apparent to those of ordinary skill in the relevant arts. It is not intended that coverage be limited to the embodiment shown, but only by the terms of the following claims.

I claim:

1. A keyboard having a two dimensional array of keys, each key having a key top and each movable along an axis, said keys arranged in a plurality of rows where said plurality of rows has two outer rows and whose key tops are located in surface of curved profile, comprising:

a key holder plate having mutually orthogonal width, length and thickness, the width generally extending between first and second parallel lines and the length extending between first and second ends, said key holder plate being relatively rigid along its length and having graduated flexibility across its width, its flexibility decreasing with distance from the first or second lines to a location intermediate the first and second lines said key holder plate having an array of key guide apertures extending through its thickness along axes of key movement transverse to said width and length;

a plurality of keys mounted in the key guide apertures;

a substantially rigid base underlying said key holder plate; and snap retaining means between said base and said key holder plate, said snap retaining means located inboard of the outer rows of keys, and between the first and second ends of said base for restraining the portion of said key holder plate along said location to a position outside the plane defined by the first and second lines to configure the array of key tops and a surface of curved profile.

2. The keyboard of claim 1 wherein said key holder plate is formed with rows of axially aligned slots therethrough parallel with the first and second lines, the slots being of graduated length, the longest slots being in rows nearest the first and second lines and the slots decreasing in length with distance from the first or second lines to provide graduated flexibility of said key holder plate across its width.

3. The keyboard of claim 2 wherein said key holder plate is formed with grooves in a surface thereof, the grooves coinciding with the rows of slots through said key holder plate to increase flexibility thereof across its width.

4. The keyboard of claim 3 wherein said key holder plate has a rib lying along each of the first and second lines and projecting from its lower surface toward said base.

5. The keyboard of claim 4 wherein said snap retaining means comprises:

a plurality of resilient bails projecting from said base and extending through holes through said key holder plate along said location intermediate the first and second lines; and a plurality of lateral projections on said key holder plate associated with said holes therethrough, said bails being adapted to snap over said lateral projections to hold that portion of said key holder plate in a position toward said base from the plane defined by the first and second lines.

6. The keyboard of claim 5 further including key return means between said base and key holder plate for biasing said keys to an undepressed position, said key return means comprising a resilient frustoconical boot associated with each key, each boot having an external end abutting the associated key.

7. The keyboard of claim 6 further including a membrane capacitive switch assembly overlaying said base beneath said key return means, said switch assembly having an array of capacitive switches selectively actuable by depression of individual keys in said plurality of keys.

8. The keyboard of claim 7 wherein:

said switch assembly comprises a first dielectric sheet having a first array of conductive areas on a first surface thereof, the first array of conductive areas being electrically connected in rows of such areas, said first sheet having a second array of conductive areas on a second surface thereof, said switch means further comprising a second dielectric sheet overlaying said first sheet and having a third array of conductive areas thereon, the third array of conductive areas being electrically connected in columns of such areas, the first, second and third arrays of conductive areas being arranged so that a conductive area in each of said first, second and third arrays is substantially centered on the axis of each of said keys, said switch assembly further comprising means for normally maintaining predetermined spacing between the second and third arrays of conductive areas, depression of a key causing an internal surface of the switch actuator/-key return element associated with the key to contact said second dielectric sheet at the location of the corresponding conductive area in the third array of conductive areas and reduce its spacing from the corresponding conductive area in the second array of conductive areas.

9. A keyboard comprising:

a base with a concave upper surface thereon, the upper surface being curved about an axis;

a membrane switch assembly overlaying the concave surface on said base, said switch assembly forming a plurality of rows of switches, the rows being generally parallel with said axis, the switches being individually actuatable by exerting force on the switch assembly at the switch location;

an array of resilient frustoconical boots overlaying said switch assembly and arranged in a plurality of rows so that a boot is substantially aligned with each switch location, each boot having a large open end adjacent said switch assembly and a small closed end of which the inner surface contacts the switch assembly when the boot is depressed;

a key holder plate having an array of key guide apertures therethrough and arranged in a plurality of rows so that a key guide aperture is substantially aligned with each switch location, said key holder plate being substantially rigid along the rows of key guide apertures and having graduated flexibility transverse to the rows of key guide apertures, with the area of maximum stiffness located between the outer rows;

a plurality of keys mounted in the key guide apertures for movement toward and away from said base, the outer surfaces of the small ends of said boots abutting said keys so as to bias them away from said base; and snap retaining means for securing said key holder plate to said base in a concave profile about said axis, said snap retaining means including a plurality of fasteners spaced along the area of maximum stiffness of said key holder plate for restraining said key holder toward said base.

10. The keyboard of claim 9 wherein said fasteners each comprise a resilient projection extending from said base through a hole into said key holder plate.

11. The keyboard of claim 10 wherein said snap retaining means includes a pair of ribs parallel with said axis extending from a surface of said key holder plate toward said base, said ribs being located adjacent the outer rows of key guide apertures and functioning in combination with said plurality of fasteners to maintain said key holder plate in a concave profile.

12. A method of producing a keyboard having a two dimensional array of keys whose key tops define a surface of concave profile curved about an axis, the method comprising the steps of :

providing an actuator assembly including a plurality of depressable keys mounted in a plate in an array of key guide apertures arranged in a plurality of parallel rows, the key holder plate being substantially rigid along the rows of key guide apertures and having graduated flexibility transverse to the rows of key guide apertures, with the area of maximum stiffness located substantially midway between the outer rows;

providing a switch assembly including a substantially rigid base having a concave upper surface thereon curved about an axis, a membrane assembly overlaying the concave surface on the base and having an array of electrical switching elements therein arranged in a pattern corresponding to the pattern of key guide apertures in the actuator assembly, and an array of key return elements overlaying the membrane assembly in a pattern corresponding to the pattern of key guide apertures in the actuator assembly, the switching elements being individually actuatable by exerting a force on the membrane assembly at the switching element locations; and attaching the actuator assembly to the concave upper surface of base of the switch assembly in a manner that the rows of key guide apertures are parallel with the axis of curvature of the concave surface, the edges of the key holder are held spaced from the concave surface, and the area of maximum stiffness of the key holder is drawn toward the curved surface by means of a plurality of fasteners spaced along the length of the area of maximum stiffness, whereby the key holder is restrained in a concave profile.

* * * * *